United States Patent [19]

Hartman et al.

[11] Patent Number: 4,982,064

[45] Date of Patent: Jan. 1, 1991

[54] MICROWAVE DOUBLE-BAG FOOD CONTAINER

[75] Inventors: Richard R. Hartman; Bradley D. Berger; Kimberly J. DeHaan, all of Kalamazoo, Mich.

[73] Assignee: James River Corporation of Virginia, Richmond, Va.

[21] Appl. No.: 529,775

[22] Filed: May 31, 1990

Related U.S. Application Data

[63] Continuation of Ser. No. 368,568, Jun. 20, 1989, abandoned.

[51] Int. Cl.[5] ..... H05B 6/80

[52] U.S. Cl. ..... 219/10.55 E; 219/10.55 F; 426/107; 426/234; 426/243; 99/DIG. 14; 383/113

[58] Field of Search ..... 219/10.55 E, 10.55 F; 426/107, 109, 112, 113, 234, 241, 243; 99/DIG. 14; 126/390; 383/104, 109, 113

[56] References Cited

U.S. PATENT DOCUMENTS

| | | | |
|---|---|---|---|
| 4,190,757 | 2/1980 | Turpin et al. | 219/10.55 E |
| 4,230,924 | 10/1980 | Brastad et al. | 219/10.55 E |
| 4,267,420 | 5/1981 | Brastad | 219/10.55 F |
| 4,518,651 | 5/1985 | Wolfe, Jr. | 219/10.55 E |
| 4,553,010 | 11/1985 | Bohrer et al. | 219/10.55 E |
| 4,641,005 | 2/1987 | Seiferth | 219/10.55 E |
| 4,705,707 | 11/1987 | Winter | 426/110 X |
| 4,734,288 | 3/1988 | Engstrom et al. | 426/107 |
| 4,777,053 | 10/1988 | Tobelmann et al. | 426/107 |
| 4,794,005 | 12/1988 | Swiontek | 426/107 |
| 4,820,893 | 4/1989 | Mode | 219/10.55 E |
| 4,851,632 | 7/1989 | Kaliski | 219/10.55 E |
| 4,857,342 | 8/1989 | Kappes | 426/107 |
| 4,864,089 | 8/1989 | Tighe et al. | 219/10.55 E |
| 4,883,936 | 11/1989 | Maynard et al. | 219/10.55 F |

FOREIGN PATENT DOCUMENTS

| | | |
|---|---|---|
| 0242952 | 10/1987 | European Pat. Off. . |
| 0256791 | 2/1988 | European Pat. Off. . |

*Primary Examiner*—Philip H. Leung

*Attorney, Agent, or Firm*—William A. Aguele; Richard J. Gallagher; Thomas H. Whaley

[57] ABSTRACT

A package for use in cooking or heating a food product in a microwave oven which comprises an outer paper container and an inner liner and a microwave interactive heater comprising a coating composition printed onto the surface of a suitable substrate or a selected portion of the outer container or inner liner. The coating composition preferably comprises finely divided carbon, aluminum flake, clay and a binder in a preferred embodiment, a polyester inner liner eliminates the need for an overwrap in packages containing a food product, such as popcorn and an oil.

10 Claims, 2 Drawing Sheets

MICROWAVE DOUBLE-BAG FOOD CONTAINER

This is a continuation of application Ser. No. 07/368,568, filed June 20, 1989 now abandoned.

This invention relates to a package for foods in which the contents may be heated by microwave radiation. In one of its more specific aspects, this invention relates to a food package for raw, cooked, or partially cooked foods and shortening, e.g. butter or oil, hydrogenated oil, normally solid vegetable oil, animal fat, and the like. In another of its more specific aspects, this invention relates to a package for corn kernels and oil or shortening which includes a microwave responsive heating element. A preferred embodiment comprises a composite package or bag comprising an inner liner or and a paper outer container or bag having a microwave responsive heating element on an outer surface of the inner liner or on the outer or inner surface of the outer container.

Numerous containers, including paper or plastic boxes and bags, have been devised for use as packages for foods which are suitable also as utensils for heating or cooking the food in a microwave oven. Many such containers are referred to in European Patent Application Publication Number 256,791, incorporated herein by reference. Some of the prior art containers comprise a heating element which is highly responsive to microwave radiation to produce a more highly elevated temperature in one or more selected areas of the container than that in the rest of the container. One type of heating element comprises metal particles, usually aluminum, vacuum deposited on a polyester film; the metallized film is then laminated onto paper or paperboard. The thus metallized paper or paperboard can then be used in a microwave oven to heat, brown or sear food items placed on the metallized paperboard or in packages comprising metallized paperboard. While such structures can be very effective as heaters, the vacuum deposition process does not readily lend itself to coating selected areas of the film or the application of varying amounts of metal particles or metallized coating to selected areas of the finished carton or structure.

Other methods of forming microwave responsive heating elements involve dispersing particles which are microwave energy absorbers, e.g. carbon, metals, and metal alloys, in a binder and forming a sheet or laminate comprising the dispersed particles. Turpin, U.S. Pat. No. 4,190,757 discloses heaters which comprise a layer of particulate lossy materials, e.g. carbon, iron and various metal oxides, or alloys, in an inorganic binder, e.g. sodium silicate. U.S. Pat. No. 4,264,668 to Balla discloses a heating element made up of a layer of carbon black in an acrylate binder laminated between a carrier layer, e.g. paper, cardboard or plastic material, and an outer layer of thermoplastic material. European Patent Application Publication No. 242,952 discloses a heating element made up of a metal or metal alloy in flake form in a thermoplastic dielectric matrix on a dielectric substrate.

The present invention provides an improved food package comprising a microwave interactive composition coated or printed on paper, polyester or paperboard forming a part of the package.

One preferred embodiment of the present invention includes a multi-layered bag comprising an inner bag or liner of greaseproof paper or polyester film and an outer bag of paper with an integral microwave heating element on the outer surface of the inner bag or on the outer or inner surface of the outer bag. The microwave heating element is made up of a microwave reactive coating applied directly, suitably by a conventional coating or printing process, on a selected surface of the bag or on a suitable substrate. In a preferred embodiment of the invention the microwave reactive coating is applied to the inner surface of the outer bag or container. Alternatively, the microwave reactive coating may be applied directly to the outer surface of the inner or outer bag or container. A preferred microwave interactive coating composition is that disclosed in the commonly assigned copending U.S. patent application of Kenneth A. Pollart et al, Ser. No. 07/239,544, incorporated herein by reference. A preferred coating composition comprises carbon black, at least one finely divided metal or metal oxide, clay, and a dielectric solid organic binder in a carrier liquid.

FIG. 1 of the drawings is a perspective view of a popcorn bag or similar food container.

FIG. 2 of the drawings is a perspective view of the opposite side of the bag illustrated in FIG. 1.

Figure 1:
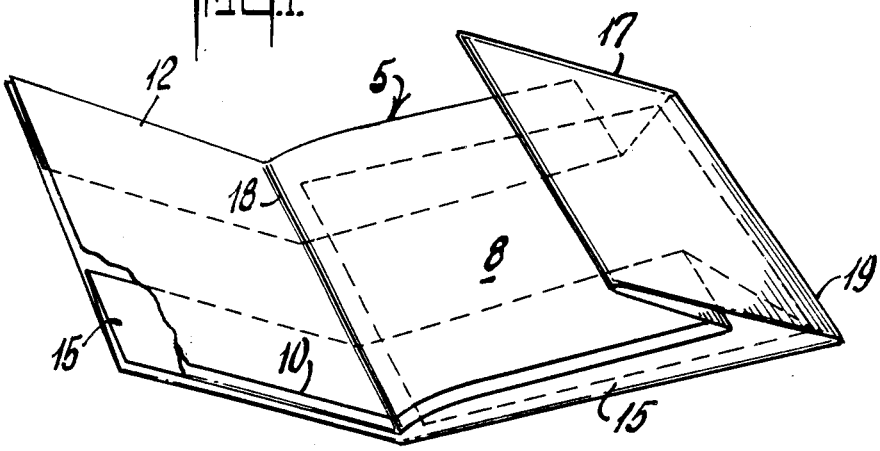
Figure 2:
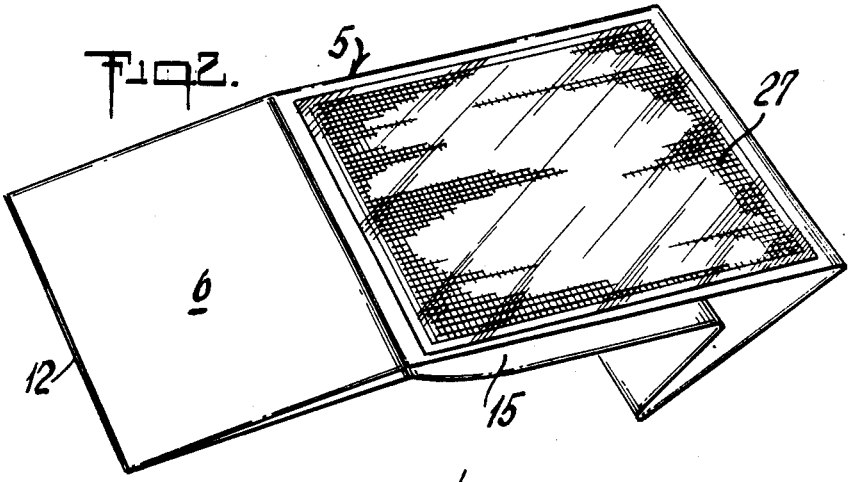

With reference to FIGS. 1 and 2 of the drawings, a filled food container, e.g. a popcorn bag 5, of our invention is illustrated. The bag comprises a front side 6 and a back portion 8 with a sealed side seam 10. The top end portion of the front side 6 of bag 5 may be sealed to the back side 8 of the bag. The bag is provided with gusseted side panels 15 which extend from the top of the bag to a conventional bottom section 17. As illustrated, the popcorn and oil occupy a mid section of the bag between fold lines 18 and 19. A printed heater 27, described in more detail hereinafter, is provided in the area of the package adjacent the popcorn.

Figure 4:
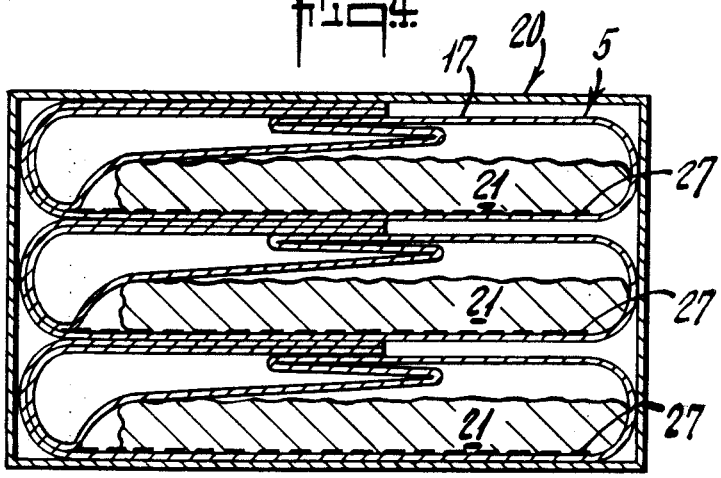
FIG. 4 is an elevational view in cross section through one end of a paperboard carton containing filled bags of the type illustrated in FIG. 1.

FIG. 4 illustrates a package 20 of paperboard with three filled food container bags packaged for distribution and sale to consumers. As illustrated, a load of food e.g. popcorn and oil, 21 occupies the mid section of the bag and the two end sections of the bag comprising top portion 12 and bottom portion 17 fold over the food containing portion to form a compact unit for packaging.

Figure 3:
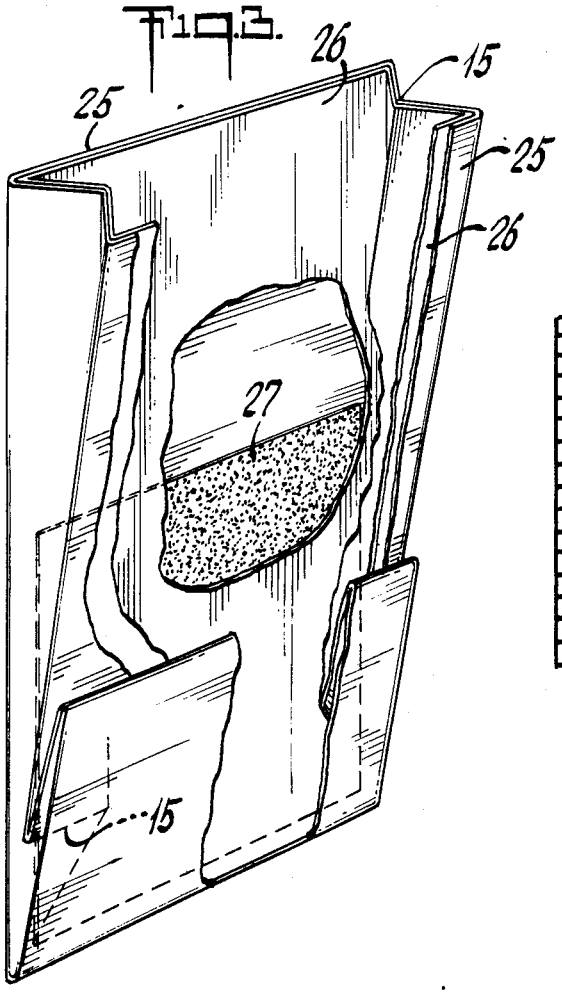
FIG. 3 is a perspective view of an empty bag illustrating a preferred embodiment with portions cut away to show its interior construction and printed microwave heater element.

FIG. 3 illustrates in more detail the construction of a preferred popcorn bag embodiment of our invention. The container is made up of a paper outer bag 25 and a greaseproof paper or polyester inner bag or liner 26 which may be fused or adhesively laminated to the outer bag.

Figure 5:
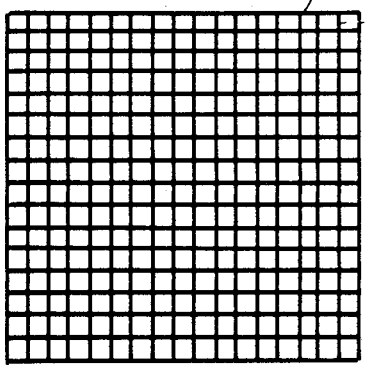
FIG. 5 is an illustration of a preferred pattern for a printed microwave reactive heater element as employed in the microwavable food containers of this invention.

In this embodiment, the microwave heater 27 is printed as a solid pattern on the inner surface of the paper outer bag 25. A preferred alternate heater pattern is illustrated in FIG. 5. As illustrated in FIG. 5, the printed heater is in the form of a pattern. A preferred grid pattern, illustrated in FIG. 5, has an open unprinted area approximately equal to the printed area. This pattern has been demonstrated to produce a uniform distribution of heat response to microwave radiation. Other continuous patterns, such as contiguous polygons, interlocking circles, lace patterns, and the like, also may be employed.

While we have shown in the figures, representative illustrative embodiments of microwave food packages included in this invention, it will be obvious that the invention is not limited to the specific structures illustrated and described herein. For example, the heating element need not necessarily be applied directly to one of the surfaces of the container itself but may be applied to a suitable substrate of paper, polyester, or the like and then inserted into the package or attached to the desired area of the container. As another example, not illustrated, the heating element may be contained in or printed on the bottom 17 of a bag of the type illustrated in FIGS. 1 to 3.

In one specific example, a preferred printed heater for a popcorn bag containing 70 grams of corn kernels which normally yield a popped volume of 2500 cubic centimeters is one in the form of a square or rectangle having a total area of about 25 to 35 square inches (about 160 to 225 square centimeters). The heater is preferably printed in the form of a grid pattern as illustrated in FIG. 5 with a coating weight in the range of from about 0.5 to about 8 pounds per 3000 sq.ft. ream. Alternatively, the heater may be printed as a solid patch as illustrated in FIG. 3 at a coating weight in the range of from about 0.5 to about 8 pounds per ream. Tests results indicate that a more uniform temperature response to microwave energy radiation is produced with a discontinuous pattern, e.g., the grid pattern, than with a solid patch coating.

Heaters printed as a solid patch coating as illustrated in FIG. 3 by a gravure press at 85 lines, 100 lines, 135 lines and 175 lines per inch produced satisfactory temperature response for popping corn in a 700 watt microwave oven. Grid pattern heaters as illustrated in FIG. 5 printed on a gravure press at 85 lines and 100 lines per inch exhibited better performance than the heaters with a solid printed pattern with less tendency to form "hot spots".

Other patterns, including a pattern of interconnected concentric circles, a basket weave pattern, and the like, not illustrated, are also possible variations of the illustrated grid pattern and are within the scope of this invention.

As disclosed in commonly assigned copending patent application, Ser. No. 07/239,544, the preferred printing compositions are composed of carbon black, finely divided flake aluminum, clay, and a synthetic resin binder in a suitable carrier vehicle. Preferred binders include aqueous or non-aqueous solutions or dispersions of a polymer precursor that serve as both binder and vehicle for the remaining solid components. Those binders which are suitable for use in printing inks are suitable for use as binder and vehicle for the carbon black, aluminum and clay components of the printable composition from which the heater is formed. Generally available latex formulations marketed for that purpose are preferred. While latex formulations are preferred as binders, a non-aqueous solvent formulation of a binder, for example, the product marketed by Morton Chemical Company under the trade name Morez 100, also has been found suitable for this purpose.

Preferred components of the heater printing composition include carbon in the form of carbon black or graphite, and a finely divided metal component, e.g. aluminum, tin, bronze, nickel, and the like, which are conductive or semiconductive or ferromagnetic materials capable of converting microwave radiation energy to heat. The inert powdered solid temperature moderators suitable for use in these formulations include clays, e.g. kaolin and English china clays, alumina, alumina hydrate (aluminum hydroxide), aluminosilicates, silica, calcium carbonate, titanium dioxide, and the like. The temperature moderator should be essentially inert and substantially unresponsive or only mildly responsive to microwave radiation. Preferred binders comprise synthetic resins in a suitable vehicle; especially preferred binders include polymer latex formulations marketed for this purpose.

The relative proportions by weight of carbon to metal in the composition may be within the range of form about 1:2 to about 2:1 with a preferred range of from about 1:1.5 to 1.5:1. The preferred ration of carbon black to aluminum flake is about 0.6. The content of the inert temperature moderator ingredient, e.g. clay, in the composition may range from about 10 percent by weight of the total (dry basis) weight to about 35 percent.

The relative proportions of binder solids to the remaining solids making up the heater components may be in the range of from about 0.3:1 to 1:1. A binder solids content in the range of from about 30 to about 40 weight percent of the total composition weight is generally preferred. Preferably only enough binder is used to adequately bond the solid coating components to one another and to the substrate.

In a preferred embodiment, wherein the microwave reactive material is a mixture of carbon black and aluminum flake with clay as a moderator, collectively referred to as pigment, and the binder is an acrylic emulsion, the pigment to binder weight ratio should be about 2:1 to or higher. The weight ratio f carbon black to aluminum flake can be varied from about 2:1 to 1:2 without having a major effect on temperature response.

Other materials can be included in the coating composition, such as surfactants, dispersion aids and other conventional additives used in coating and printing compositions to facilitate application of the coating composition to the substrate by rotogravure or other suitable printing or coating methods. The coating can be applied using conventional printing and coating processes, e.g., rotogravure, silk screen, flexography, air knife, rolls, blade, etc. After the coating composition has been applied it can be dried using conventional drying ovens normally provided in web printing and coating processes.

The following examples of test results demonstrate particular embodiments of this invention and some of the possible variations in- compositions and coatings which may be adapted to varying consumer product needs.

In the following examples, all coating formulations were applied to a 40 lb/3000 sq. ft. uncoated, bleached kraft paper with a Bird applicator and dried on a photo drier at 200° F. Unless otherwise specified, the biner used was a combination of Rhoplex B-15, an acrylate latex supplied by Rohm & Haas Company and Lucidene 602, a styrene/acrylic latex supplied by Morton Chemical Company and commonly used in aqueous printing inks.

In all cases the carbon black was dispersed (using a shot mill) into part or all of the Lucidene 602 binder used in the formulation with additional water added as necessary to obtain the desired viscosity. After the carbon black was uniformly dispersed, it was transferred to a container equipped with a propeller type mixer. The remaining binder (Lucidene 602 and/or Rhoplex B-15), as well as the remaining components, were gradually added along with additional water as needed. In each case, agitation was continued until a uniform mixture was obtained. The heater response of these coatings was determined by placing a printed bag in a Litton microwave oven (Model 2238, 700 watt rating). The sample was supported 2 inches off the bottom of the oven with a glass ring and the temperature response was measured with a Hughes Probeye Thermal Video System.

In typical applications, such as popcorn bags, printed heaters made up with our printable microwave interactive coatings utilizing the partial area coverage patterns, for example, the grid pattern, are capable of providing the desired level of temperature response for a given load requirement. It is easy, for example, to select a coating weight with a temperature response required to yield a high volume of popped corn with a minimum number of unpopped kernels while at the same time minimizing the tendency to cause scorching of the paper bag.

Pattern coatings, e.g. the grid pattern, covering 35 to 80 percent of the heater surface area will usually provide the desired temperature response over the entire printed area. Preferably, the area covered by the coating forming the pattern is within the range of 40 to 75 percent of the heater area.

EXAMPLE

A microwave reactive coating composition was prepared with 19 weight percent carbon black, 27 weight percent aluminum flake, 18 percent kaolin, and 34 weight percent binder from a 1:2 mixture of Lucidene 602 and Rhoplex B-15.

The solids, viscosity and surface tension of the formulation were adjusted by the addition of water, alcohol and carboxymethylcellulose as necessary for excellent runnability on a full scale gravure printing press at 250 ft/min. Heater test specimens were prepared by rotogravure printing of a 25 square inch heater on paper using the pattern illustrated in FIG. 5 with print lines 1.8 mm wide and 4.5 mm square openings, thus providing an area coverage by the heater composition of approximately 50 percent.

The test specimens are identified as follows.

| Specimen | Printing Apparatus | Coating Weight lb/3000 sq ft |
|---|---|---|
| X | 65 line screen gravure cylinder | 7.1 |
| Y | 100 line screen gravure cylinder | 3.8 |
| Z | 133 line screen gravure cylinder | 2.5 |

Figure 6:
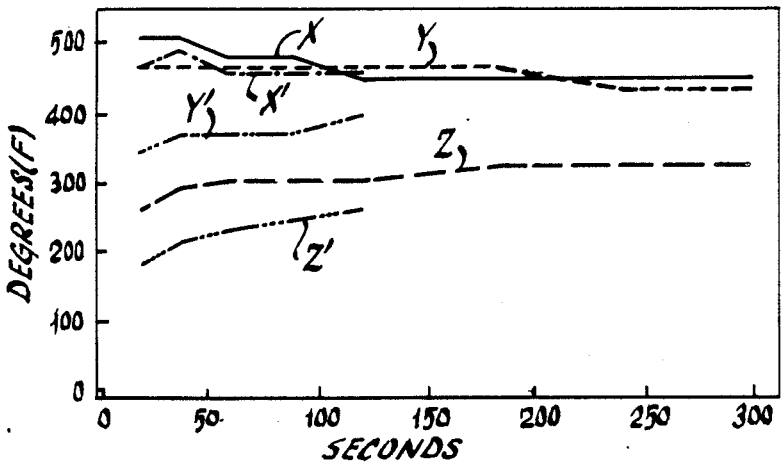
FIG. 6 is a graphic illustration of typical heater responses for heating elements made according to this invention.

Heater response tests were carried out in a 700 watt Litton microwave oven with and without an added load. The test results are illustrated graphically in FIG. 6 wherein X, Y, and Z designate tests of the specimens under no load conditions and X', Y', and Z' designate test results with the same heaters with a 200 g. water load. The test results demonstrate the uniformity of temperature over relatively long periods of time obtainable with these heaters.

We claim:

1. A paper bag food container which can be placed in a microwave oven to heat the food therein comprising a greaseproof inner bag to hold said food, a paper outer beg surrounding and adhesively attached to said inner bag, and a heating element comprising a coating of a microwave reactive composition of a finely divided microwave reactive metal, carbon black, powdered inert solid material and a dielectric binder applied directly to the inner surface of the outer beg and adhesively attached to the outer surface of the inner bag.

2. A paper food container as defined in claim 1 wherein the inner bag comprises a polyester film.

3. A paper food container as defined in claim 1 wherein the inner bag is formed of a polyester film.

4. A paper food container as defined in claim 1 wherein the inner bag is formed of greaseproof paper.

5. A food container according to claim 1 wherein the metal is aluminum.

6. A food container according to claim 1 wherein the dielectric binder is a water based latex emulsion.

7. A food container according to claim 1 wherein the powdered inert solid material is clay.

8. A food container according to claim 1 wherein the powdered inert solid material is silica.

9. A food container according to claim 1 wherein the heating element on the inner surface of the outer bag is applied in the form of a grid pattern wherein the area covered by the microwave reactive coating composition forming the pattern is within the range of 35 to 80 percent of the total area of the heating element.

10. A food container according to claim 9 wherein the area covered by the microwave reactive coating composition of the grid pattern is approximately equal to the uncoated area contained within the grid pattern.

* * * * *

UNITED STATES PATENT AND TRADEMARK OFFICE

CERTIFICATE OF CORRECTION

PATENT NO. : 4,982,064

DATED : January 1, 1991

INVENTOR(S) : Richard R. Hartman, et al

It is certified that error appears in the above-identified patent and that said Letters Patent is hereby corrected as shown below:

Title Page:

[54]"MICROWAVE" should be --MICROWAVABLE--.

Column 1, title line, "MICROWAVE" should be --MICROWAVABLE--.

Signed and Sealed this

Twenty-third Day of February, 1993

*Attest:*

STEPHEN G. KUNIN

*Attesting Officer*

*Acting Commissioner of Patents and Trademarks*